US011849904B2

(12) United States Patent
Mockridge et al.

(10) Patent No.: US 11,849,904 B2
(45) Date of Patent: Dec. 26, 2023

(54) CLEANER HEAD FOR A VACUUM CLEANER

(71) Applicant: Dyson Technology Limited, Wiltshire (GB)

(72) Inventors: Richard Iain Mockridge, Gloucester (GB); Anthony Andrew Buchanan Harker, Oxford (GB); William James Baker, Swanage (GB)

(73) Assignee: Dyson Technology Limited, Wiltshire (GB)

( * ) Notice: Subject to any disclaimer, the term of this patent is extended or adjusted under 35 U.S.C. 154(b) by 768 days.

(21) Appl. No.: 16/976,661

(22) PCT Filed: Feb. 26, 2019

(86) PCT No.: PCT/GB2019/050528
§ 371 (c)(1),
(2) Date: Aug. 28, 2020

(87) PCT Pub. No.: WO2019/166794
PCT Pub. Date: Sep. 6, 2019

(65) Prior Publication Data

US 2020/0405105 A1 Dec. 31, 2020

(30) Foreign Application Priority Data

Mar. 1, 2018 (GB) ..... 1803345

(51) Int. Cl.
*A47L 9/06* (2006.01)
*A47L 9/04* (2006.01)

(52) U.S. Cl.
CPC ..... *A47L 9/0666* (2013.01); *A47L 9/0411* (2013.01); *A47L 9/0438* (2013.01); *A47L 9/0494* (2013.01)

(58) Field of Classification Search
CPC .... A47L 9/0666; A47L 9/0411; A47L 9/0438; A47L 9/0494
See application file for complete search history.

(56) References Cited

U.S. PATENT DOCUMENTS 3,012,267 A 12/1961 Kemnitz
3,639,941 A 2/1972 Kirwan et al.
(Continued)

FOREIGN PATENT DOCUMENTS

DE 102010000577 A1 8/2011
DE 102015100483 A1 7/2016
(Continued)

OTHER PUBLICATIONS

International Search Report and Written Opinion dated May 14, 2019, directed to International Application No. PCT/GB2019/050528; 12 pages.
(Continued)

*Primary Examiner* — David Redding
(74) *Attorney, Agent, or Firm* — Faegre Drinker Biddle & Reath LLP

(57) ABSTRACT

A cleaner head for a vacuum cleaner has a housing, an agitator mounted within the housing, and a drive mechanism for driving the agitator about a first axis A. The drive mechanism is mounted to the housing for rotation about a second axis R. The second axis R is offset from the first axis A. When the agitator is brought into contact with a surface to be cleaned, the surface exerts a reaction torque on the agitator that causes the drive mechanism to rotate about the second axis R.

19 Claims, 13 Drawing Sheets

(56) References Cited

U.S. PATENT DOCUMENTS

| | | | |
|---|---|---|---|
| 3,802,026 | A | 4/1974 | Crener |
| 4,268,769 | A | 5/1981 | Dorner et al. |
| 4,351,078 | A | 9/1982 | Sternberg |
| 4,531,249 | A | 7/1985 | Sternberg |
| 4,976,003 | A | 12/1990 | Williams |
| 5,056,175 | A | 10/1991 | Stein et al. |
| 6,243,917 | B1 | 6/2001 | Conrad |
| 7,448,113 | B2 | 11/2008 | Jones et al. |
| 2004/0154114 | A1 | 8/2004 | Stein et al. |

FOREIGN PATENT DOCUMENTS

| | | | |
|---|---|---|---|
| GB | 1323259 | A | 7/1973 |
| GB | 2336994 | A | 11/1999 |
| GB | 2499214 | A | 8/2013 |
| JP | 64-049523 | A | 2/1989 |
| JP | 09-108154 | A | 4/1997 |
| JP | 2001-321304 | A | 11/2001 |
| JP | 2016-052511 | A | 4/2016 |
| WO | 2016/034848 | A1 | 3/2016 |

OTHER PUBLICATIONS

Search Report dated Aug. 21, 2018, directed to GB Application No. 1803345.6; 1 page.

The First Office Action dated Apr. 6, 2021, directed to CN Application No. 201980016263.2; 14 pages.

Office Action received for Japanese Patent Application No. 2020-545549, dated Jan. 5, 2022, 6 pages (3 pages of English Translation and 3 pages of Original Document).

CLEANER HEAD FOR A VACUUM CLEANER

REFERENCE TO RELATED APPLICATIONS

This application is a national stage application under 35 USC 371 of International Application No. PCT/GB2019/050528, filed Feb. 26, 2019, which claims the priority of United Kingdom Application No. 1803345.6, filed Mar. 1, 2018, the entire contents of each of which are incorporated herein by reference.

FIELD OF THE DISCLOSURE

The present disclosure relates to a cleaner head for a vacuum cleaner.

BACKGROUND OF THE DISCLOSURE

Cleaner heads for vacuum cleaners typically comprise an agitator for agitating debris located upon a surface, with the agitator being rotatably mounted within a housing of the cleaner head.

As the cleaner head is moved back and forth across a surface to be cleaned, any variation of the surface, for example a variation in carpet pile depth or density, can result in a variation in the force and power applied to the carpet by the agitator. Furthermore, where the cleaner head is used on surfaces having different properties, for example carpets having differing pile thickness or density, the force and power applied to the carpet by the agitator may vary depending on the surface being cleaned.

SUMMARY OF THE DISCLOSURE

According to a first aspect of the present invention there is provided a cleaner head for a vacuum cleaner, the cleaner head comprising a housing, an agitator mounted within the housing, and a drive mechanism for driving the agitator about a first axis, wherein the drive mechanism is mounted to the housing for rotation about a second axis, the second axis is offset from the first axis, and when the agitator is brought into contact with a surface to be cleaned, the surface exerts a reaction torque on the agitator that causes the drive mechanism to rotate about the second axis.

The cleaner head according to the first aspect of the present invention may be advantageous principally as the drive mechanism is mounted to the housing for rotation about a second axis, the second axis is offset from the first axis, and when the agitator is brought into contact with a surface to be cleaned, the surface exerts a reaction torque on the agitator that causes the drive mechanism to rotate about the second axis.

In particular, as the second axis is offset from the first axis, the agitator may be movable within the housing, for example in an upward/downward and/or forward/backward direction, as the drive mechanism rotates about the second axis. When the cleaner head is placed on a surface to be cleaned in use, and the agitator contacts the surface to be cleaned, a reaction torque is experienced by the drive mechanism which causes the drive mechanism to rotate about the second axis. The initial reaction torque experienced may tend to move the drive mechanism, and hence the agitator, within the housing in a direction which reduces the reaction torque experienced, ie in a direction which moves the agitator out of contact with the surface. This reduction in reaction torque may enable the cleaner head to transfer more power to the surface than, for example, a cleaner head having an agitator which is fixed within the housing.

Furthermore, as the cleaner head is moved across the surface to be cleaned, continual adjustment of the position of the drive mechanism, and hence the agitator, within the housing due to varying reaction torques experienced may result in a smaller variation in power draw in use of the cleaner head. Such adjustment may also occur between surfaces to be cleaned.

Thus the cleaner head according to various aspects of the present invention may provide for adjustment of the agitator within the housing both as the cleaner head moves back and forth across a surface to be cleaned, and between surfaces to be cleaned, such that the cleaner head has a lower variation in electrical power draw than, for example, a cleaner head having an agitator which is fixed within the housing.

This may enable the cleaner head to operate closer to its maximum continuous operating point, for example the power draw beyond which a motor of the drive mechanism may stall or exceed its acceptable temperature limits, as large variation in power draw across different surfaces no longer needs to be taken into account. This may result in an increase in pick-up performance.

Furthermore, agitators are typically provided with bristles for agitating a surface to be cleaned, and manufacturing tolerances can cause a variation in bristle height from agitator to agitator. Such a variation in bristle height can lead to different reaction torques experienced. The cleaner head according to various aspects of the present invention may allow for adjustment of the agitator within the housing such that cleaner heads having different bristle heights have a lower variation in power draw on a common surface to be cleaned.

The drive mechanism may be movable within the housing, for example in an upward/downward and/or forward/backward direction, as the drive mechanism rotates about the second axis.

The agitator may be substantially hollow. The drive mechanism may be housed at least partially within the agitator, for example substantially entirely within the agitator. This may be beneficial as it may enable a compact arrangement. A motor and transmission of the drive mechanism may be housed within the agitator. This may be beneficial as it may protect the motor and transmission from dirty air flowing through the cleaner head in use. The agitator may be rotatable relative to the drive mechanism, for example rotatable about the drive mechanism. The agitator may comprise a cylinder which encompasses the drive mechanism, for example a cylinder which surrounds the drive mechanism and touches the drive mechanism at at least one point.

The first axis may comprise a longitudinal axis of the agitator and/or drive mechanism, for example a central longitudinal axis of the agitator and/or drive mechanism. The drive mechanism and the agitator may comprise a common central longitudinal axis, for example such that the drive mechanism and the agitator are concentrically arranged within the housing. By a central longitudinal axis of the drive mechanism is meant an axis extending longitudinally through the centre of an imaginary cylinder encompassing the drive mechanism, for example an imaginary cylinder which surrounds the drive mechanism and touches the drive mechanism at at least one point. The drive mechanism may have a substantially cylindrical global form. The second axis may be offset from a center point of the drive mechanism and/or agitator.

The second axis may be fixed relative to the housing. The second axis may be located behind the first axis, for example behind the first axis with respect to a forward direction of motion of the cleaner head in use, ie a direction of motion of the cleaner head away from the user. This may be beneficial as it may enable an arrangement where the drive mechanism, and hence the agitator, is located at a minimum height where a low initial level of reaction torque is experienced by the drive mechanism in use, and the drive mechanism, and hence the agitator, is located at a maximum height where a high level of initial reaction torque is experienced by the drive mechanism in use. This may enable the agitator to move away from the surface to be cleaned dependent on the level of reaction torque experienced, and may be in contrast to an arrangement where the second axis is located in front of the first axis. In particular, where the second axis is located in front of the first axis, the reaction torque experienced would tend to drive the agitator downward within the cleaner head, thereby further increasing the level of reaction torque experienced.

The cleaner head may comprise a stop mechanism for restricting rotation of the drive mechanism about the second axis, for example such that motion of the drive mechanism within the housing is restricted to motion between maximum and minimum heights of the drive mechanism, and hence the agitator, within the housing. This may be beneficial as it may inhibit the agitator from being positioned too close to and/or too far away from a surface to be cleaned in use. The stop mechanism may comprise a first stop member and a second stop member, the first stop member being configured to prevent motion of the drive mechanism past a position of maximum height of the drive mechanism within the housing, and the second stop member being configured to prevent motion of the drive mechanism past a position of minimum height of the drive mechanism within the housing.

Rotation of the drive mechanism about the second axis may be restricted such that substantially the entirety of the agitator is contained within the housing when the drive mechanism is at a position of minimum height within the housing. For example, substantially the entirety of the agitator save for bristles of the agitator may be contained within the housing when the drive mechanism is at a position of minimum height within the housing. This may be beneficial as it may inhibit the main body of the agitator from contacting a low power draw surface in use, for example a hard floor, and hence may inhibit damage being caused to the low power draw surface. Where substantially the entirety of the agitator is contained within the housing when the drive mechanism is at a position of minimum height within the housing, the properties of bristles of the agitator may be chosen to provide increased agitation on low power draw surfaces in use. Examples of properties include the number of strips of bristles, bristle length, bristle density, bristle thickness, and bristle stiffness.

At least a portion of the agitator may extend out of the housing when the drive mechanism is at a position of minimum height within the housing. For example, at least a portion of the main body of the agitator may extend out of the housing when the drive mechanism is at a position of minimum height with the housing. This may be beneficial as it may allow for the agitator to extend further into a surface to be cleaned in use, and hence may provide enhanced agitation of the surface to be cleaned. This may also allow for a lower number of bristle strips and/or a shorter length of bristles to be formed on the agitator.

A portion of the drive mechanism may be rotatable about the first axis to drive rotation of the agitator, whilst the drive mechanism as a whole may be rotatable about the second axis. This may be beneficial as it may enable the agitator to perform its usual agitating function whilst also allowing for the movement of the agitator within the housing previously described.

The drive mechanism may comprise first and second ends, and each of the first and second ends may be rotatably connected to the housing such that the drive mechanism is rotatable about the second axis. This may be beneficial as it may ensure that the drive mechanism is held stably within the housing, for example in comparison to a drive mechanism cantilevered within the housing.

At least a portion of the drive mechanism may rigidly connect the first and second ends. This may be beneficial as it may retain the drive mechanism and/or agitator in a position substantially parallel to a surface to be cleaned when the drive mechanism rotates about the second axis in use.

The cleaner head may comprise a biasing mechanism which exerts a biasing torque on the drive mechanism that acts in a first direction about the second axis, and when the agitator is brought into contact with a surface to be cleaned, the reaction torque on the drive mechanism acts in a second opposite direction about the second axis. Where the reaction torque is not equal to the biasing torque provided by the biasing mechanism, the drive mechanism may rotate about the second axis, thereby causing movement of the agitator within the housing.

This may be beneficial as rotation of the drive mechanism about the further rotational axis may cause a variation in the reaction torque experienced, as the agitator moves out of contact with the surface being cleaned, and rotation of the drive mechanism may continue until the reaction torque is equal to the biasing torque provided by the biasing mechanism. Such a point may be referred to as an equilibrium point, although it is recognised that the system experiences forces other than the reaction torque and the biasing torque of the biasing mechanism. Such other forces may be minimised by minimising the offset distance between the central longitudinal axis of the drive mechanism and the further rotational axis. As the cleaner head is moved across the surface to be cleaned, continual adjustment of the position of the drive mechanism, and hence the agitator, within the housing due to varying reaction torques experienced may ensure that an equilibrium point is always reached. The biasing mechanism may be configured to provide a substantially constant biasing torque, and hence the cleaner head may have a substantially constant power draw. Such adjustment may also occur between surfaces to be cleaned.

Thus the cleaner head according to various aspects of the present invention may provide for adjustment of the agitator within the housing both as the cleaner head moves back and forth across a surface to be cleaned, and between surfaces to be cleaned, such that the cleaner head has a substantially constant electrical power draw.

This may enable the cleaner head to operate closer to its maximum continuous operating point, for example the power draw beyond which the motor may stall or exceed its acceptable temperature limits, as variation in power draw across different surfaces no longer needs to be taken into account. This may result in an increase in pick-up performance.

Furthermore, agitators are typically provided with bristles for agitating a surface to be cleaned, and manufacturing tolerances can cause a variation in bristle height from agitator to agitator. Such a variation in bristle height can lead to different reaction torques experienced. The cleaner head according to various aspects of the present invention may allow for adjustment of the agitator within the housing such that cleaner heads having different bristle heights have a substantially constant power draw on a common surface to be cleaned.

When the agitator is brought into contact with the surface to be cleaned in use, the drive mechanism may rotate about the second axis in the second direction. When the agitator is lifted from the surface to be cleaned in use, the drive mechanism may rotate about the second axis in the first direction. The agitator may rotate about the first axis in the first direction.

The biasing mechanism may be configured to provide a biasing torque which is opposite to and/or equal to a reaction torque experienced by the drive mechanism in use. The biasing mechanism may be configured to provide the biasing torque in a direction corresponding to a direction of rotation of the agitator in use.

The biasing torque may retain the drive mechanism at an initial position within the housing, for example in the absence of any reaction torque. This may be beneficial as this may provide a known starting position for the drive mechanism, and hence the agitator, within the housing. The initial position may comprise a position of maximum or minimum height of the drive mechanism within the housing, for example a position of maximum or minimum distance measured orthogonal to a surface to be cleaned when the cleaner head is positioned on the surface to be cleaned.

At least a portion of the drive mechanism may define the second axis. For example, the drive mechanism may comprise at least one spigot defining the second axis.

The biasing mechanism may be connected to the at least one spigot such that the biasing mechanism is able to transmit a rotational force, for example the biasing torque, about the second axis. This may be beneficial as it may enable the biasing mechanism to oppose rotation of the drive mechanism about the second axis as a result of a reaction torque experienced when the agitator contacts a surface to be cleaned in use. Rotation of the drive mechanism about the second axis against the biasing torque exerted by the biasing mechanism may move the drive mechanism and/or agitator within the housing, for example raising and/or lowering the drive mechanism and/or agitator within the housing and/or moving the drive mechanism and/or agitator forward and/or backward within the housing.

The biasing mechanism may comprise a resiliently deformable member held under tension, and the resiliently deformable member may, for example, be connected to the at least one spigot, either directly or indirectly. The resiliently deformable member may comprise a spring. The use of a spring may provide a simple biasing mechanism which can act independently of, for example, user input and/or computerised control inputs.

The at least one spring may comprise a single spring. This may be beneficial as a single spring may enable the use of a larger pre-load to maintain the drive mechanism in an initial position within the cleaner head. A larger pre-load may mean that a given amount of spring extension will cause a smaller proportional change in the force provided by the spring. For example, a relatively small extension of the spring may produce such a small increase in force that the restorative force of the spring can be viewed as substantially constant. A larger pre-load may allow the spring to be fitted so as to pull onto a smaller radius, thereby minimising the necessary change in extension of the spring through a given angular rotation of the drive, and minimising the change in the substantially constant force provided by the spring.

The at least one spring may comprise a coil spring, or a constant force spring, or a torsional spring. A coil spring may be beneficial as coil springs are simple and inexpensive, may have a long lifetime, and may allow for relatively easy tuning of the biasing mechanism post manufacture.

The biasing mechanism may comprise an inextensible connection member connecting the resiliently deformable member to the at least one spigot. This may be beneficial as it may enable the resiliently deformable member to exert a force on the at least one spigot. The spigot may comprise a drum about which the inextensible connection member may wind and unwind. This may be beneficial as it may enable linear displacement of the resiliently deformable member to be converted into rotational movement of the at least one spigot. For example, a linear displacement force applied by the resiliently deformable member may be converted into a rotational force, ie a torque, about the second axis.

The drum may have a variable radius, for example such that a cross-section through the drum is substantially elliptical in form. This may be beneficial as it may help to minimise any variations in the biasing torque provided by the biasing mechanism.

The cleaner head may comprise at least one pulley through which the inextensible connection member passes in use. This may be beneficial as the at least one pulley may allow the at least one spring to be located remotely of the drive mechanism within the cleaner head.

The housing may comprise a chamber within which the agitator and drive mechanism are mounted, a dirty air inlet in fluid communication with the chamber, and a further chamber within which the biasing mechanism is located. This may be beneficial as the biasing mechanism may be located remotely from dirty air flow through the cleaner head in use, and hence clogging of the biasing mechanism by dirt and debris and the like may be avoided.

According to a second aspect of the present invention there is provided a vacuum cleaner comprising a cleaner head according to the first aspect of the present invention.

BRIEF DESCRIPTION OF THE FIGURES

In order to better understand the present invention, and to show more clearly how the invention may be put into effect, various aspects of the invention will now be described, by way of example, with reference to the following drawings.

DETAILED DESCRIPTION OF THE DISCLOSURE

Figure 1:
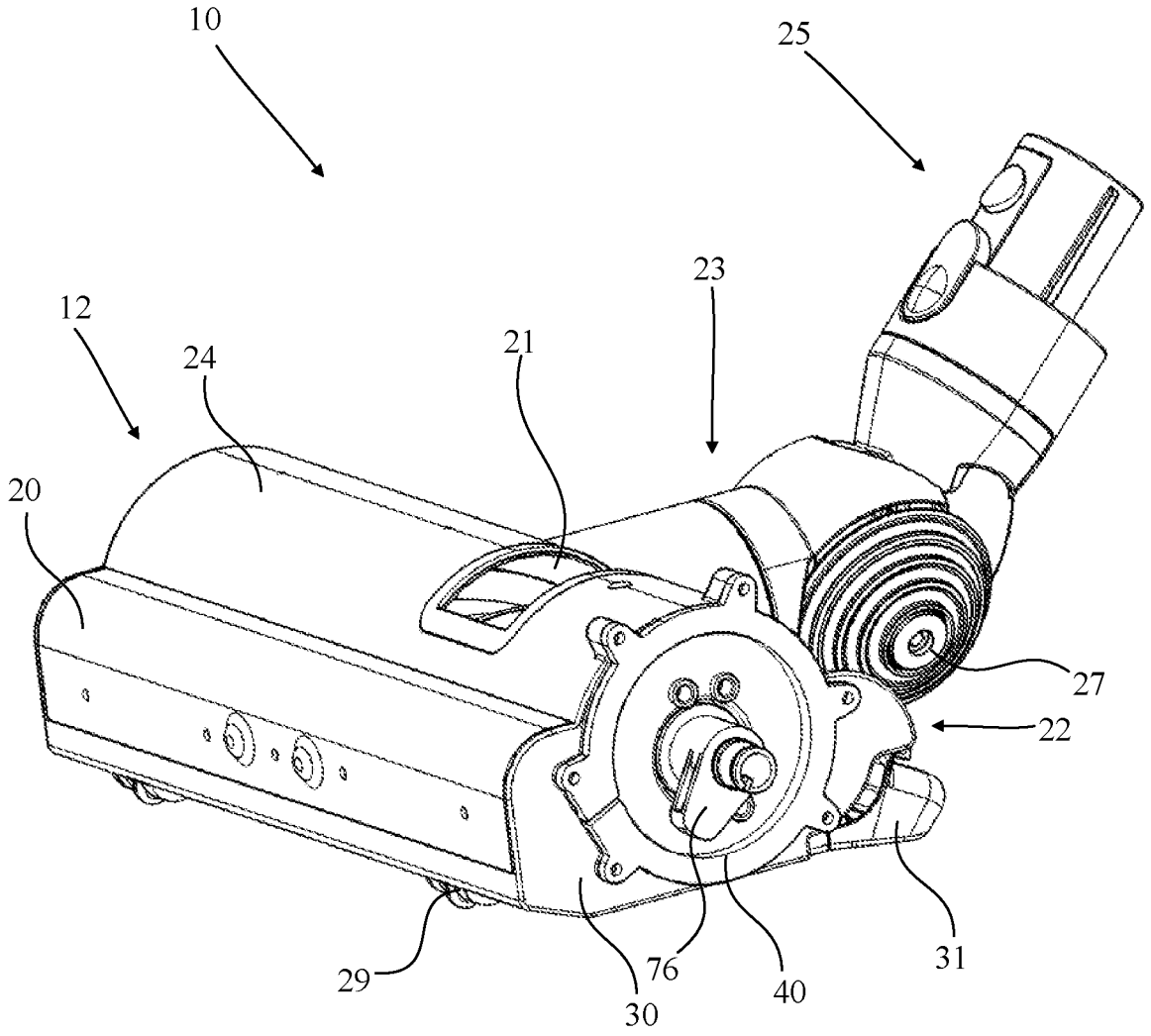
FIG. 1 is an upper front perspective view of a cleaner head according to various aspects of the present invention.
Figure 2:
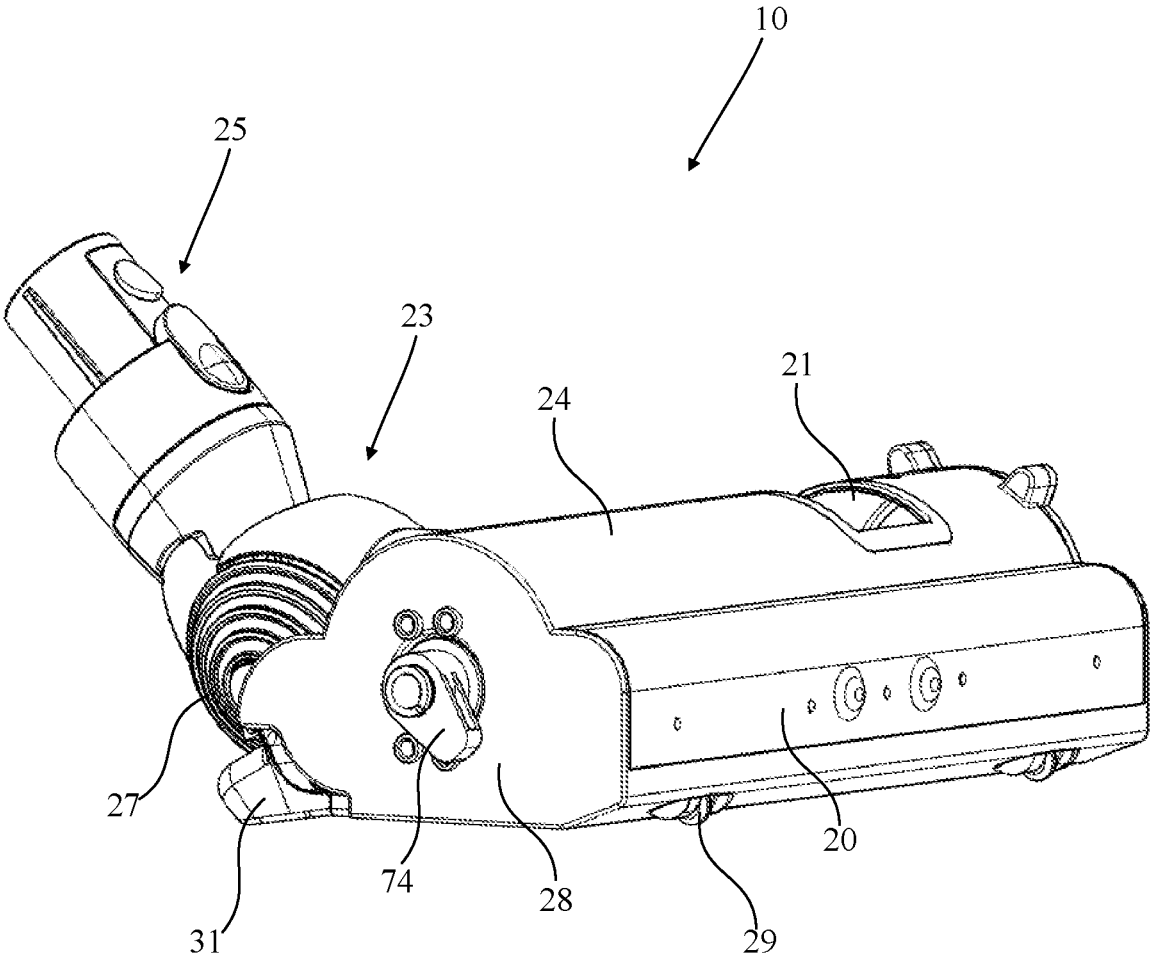
FIG. 2 is a rotated perspective view of the cleaner head of FIG. 1.
Figure 3:
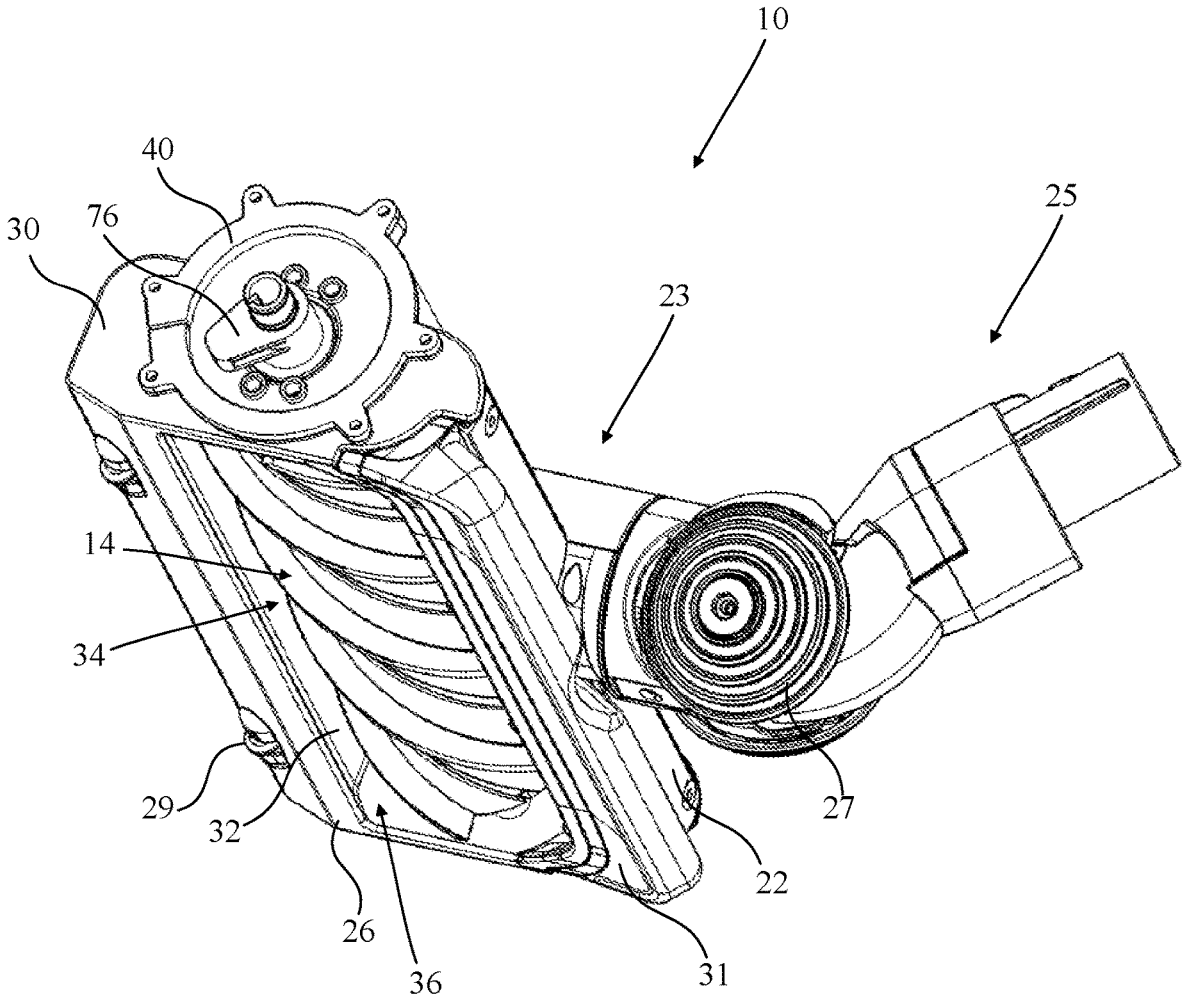
FIG. 3 is a lower rear perspective view of the cleaner head of FIG. 1.
Figure 4:
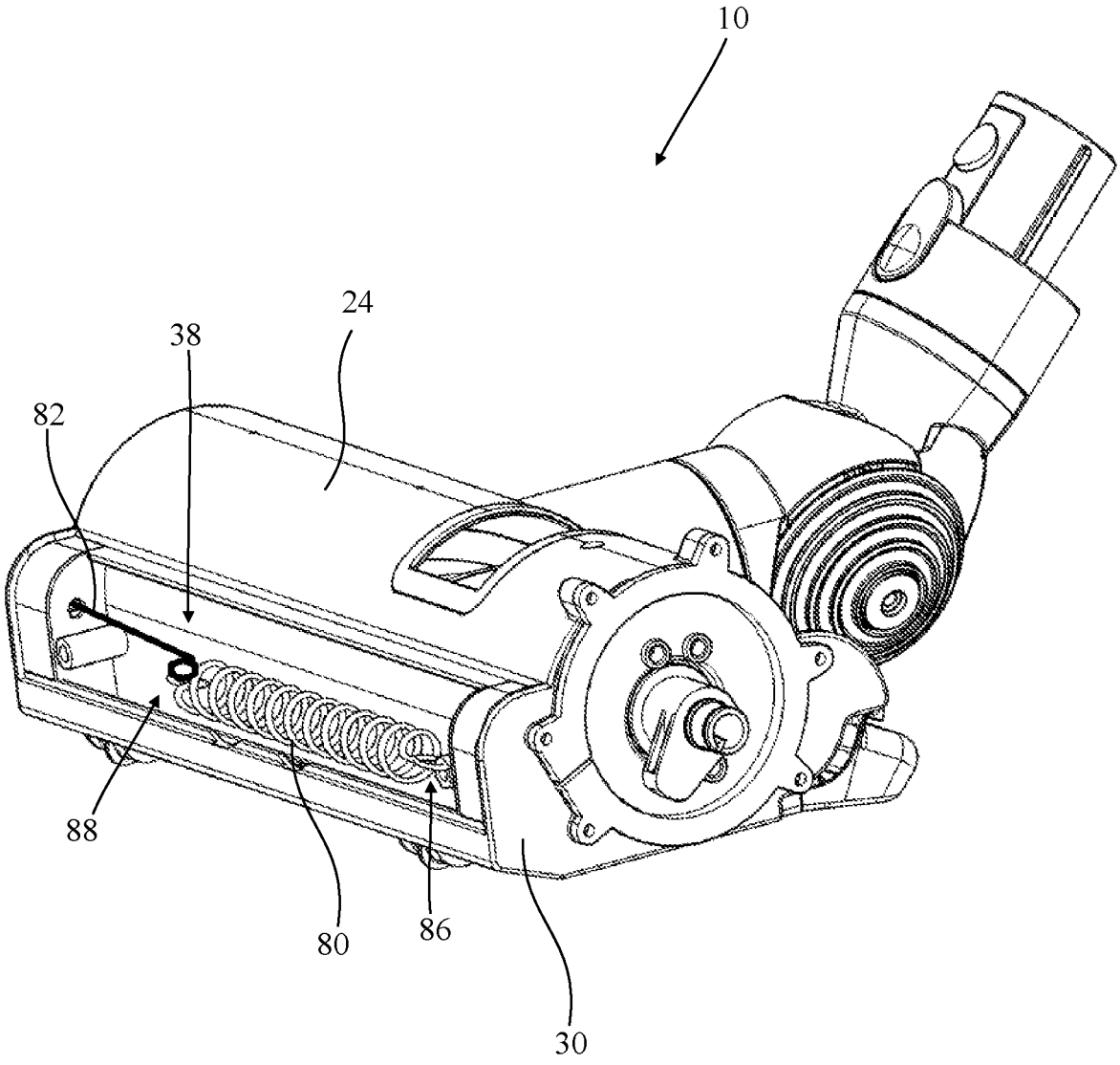
FIG. 4 is an upper front perspective view of the cleaner head of FIG. 1 with its front wall removed.

A cleaner head according to various aspects of the present invention, generally designated 10, is shown in FIGS. 1-4, 9-13, and 21-22. The cleaner head 10 has a housing 12, an agitator in the form of a brushbar 14, a drive mechanism 16, and a biasing mechanism 18.

The housing 12 is formed of a front wall 20, a rear wall 22, an upper wall 24, a soleplate 26, first 28 and second 30 side walls, and a dividing wall 32.

Collectively, the rear wall 22, upper wall 24, soleplate 26, first 28 and second 30 side walls, and the dividing wall 32, define an agitator chamber 34. The agitator chamber 34 has substantially the same shape as the brushbar 14, and is generally cylindrical in form. The agitator chamber 34 is, however, somewhat larger than the brushbar 14, and is dimensioned to enable the brushbar 14 to move within the agitator chamber 34 in use, both in an upward/downward and forward/rearward direction. The soleplate 26 has an aperture formed therein, which defines a dirty air inlet 36 of the agitator chamber 34.

Collectively, the front wall 20, soleplate 26, first 28 and second 30 side walls, and the dividing wall 32, define a front chamber 38. The front chamber 38 is shaped and dimensioned to house a spring 80 and cable 82 of the biasing mechanism 18. The front chamber 38 is substantially sealed from the agitator chamber 34 and the dirty air inlet 36, such that debris is prevented from entering the front chamber 38 in use. The front wall 20 is removable to allow access to the front chamber 38, for example to enable maintenance of the biasing mechanism 18.

The rear wall 22 has a dirty air outlet 23, leading to a connection mechanism 25 for connecting the cleaner head 10 to a vacuum cleaner 100 in use. The cleaner head 10 has a pair of wheels 27, located between the dirty air outlet 23 and the connection mechanism 25, which facilitate movement of the cleaner head 10 across a surface to be cleaned in use. The upper wall 24 has an optional viewing window 21 which may allow a user to view the brushbar 14 in use. Although not shown, the viewing window 21 comprises a transparent piece of plastic which defines part of the agitator chamber 34, such that the upper end of the agitator chamber 34 is enclosed. The soleplate 26 has a further pair of wheels 29 which also facilitate movement of the cleaner head 10 across a surface to be cleaned in use. The soleplate 26 has a flexible member 31 which contacts a surface to be cleaned in use, and may assist with sealing between the cleaner head 10 and the surface.

The second side wall 30 has an end cap 40, and the end cap 40 is removable to allow the brushbar 14 and/or the drive mechanism 16 to be removed from the agitator chamber 34 for maintenance.

Figure 5:
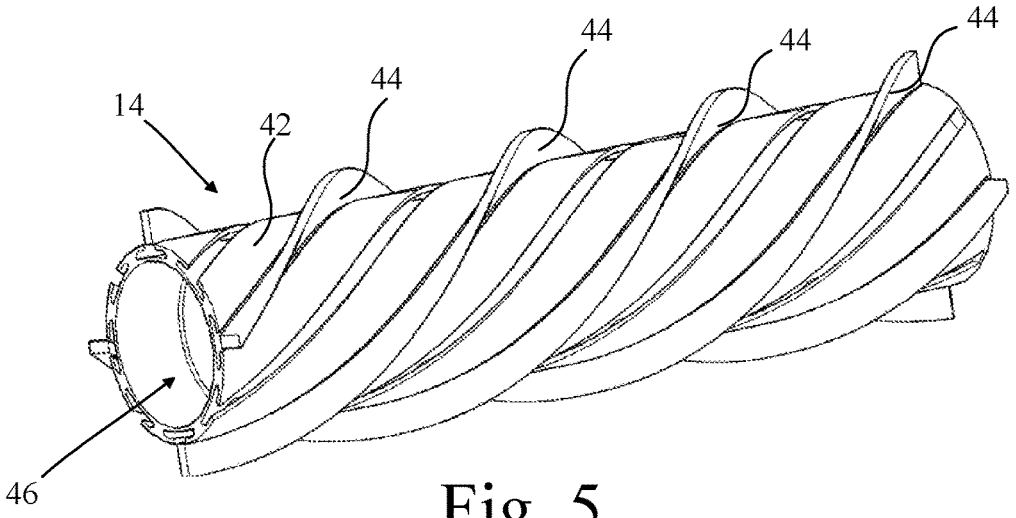
FIG. 5 is a perspective view of an agitator of the cleaner head of FIG. 1 in isolation.

The brushbar 14 is shown in isolation in FIG. 5. The brushbar 14 has a main body 42 and four strips 44 of bristles. The main body 14 is substantially cylindrical in form, and has a hollow interior 46. The main body 42 is shaped and dimensioned such that substantially the entirety of the drive mechanism 16 can be received within the hollow interior 46. Each of the four strips 44 of bristles is spaced evenly about the circumference of the main body 14, and each of the four strips 44 extends through 360 degrees about an outer surface of the main body 14. It will be apparent to a person skilled in the art that the number of strips 44, the length of the bristles, and the material of the bristles, may be varied to achieve desired agitation of a surface to be cleaned in use. In a presently preferred embodiment, the bristles are formed of nylon. As seen in FIG. 5, further bristle strips, eg carbon fibre bristle strips, can be inserted into appropriate slots formed in the main body 42 of the brushbar 14. It will be recognised that the additional slots can be removed if further bristle strips are not desired.

Figure 6:
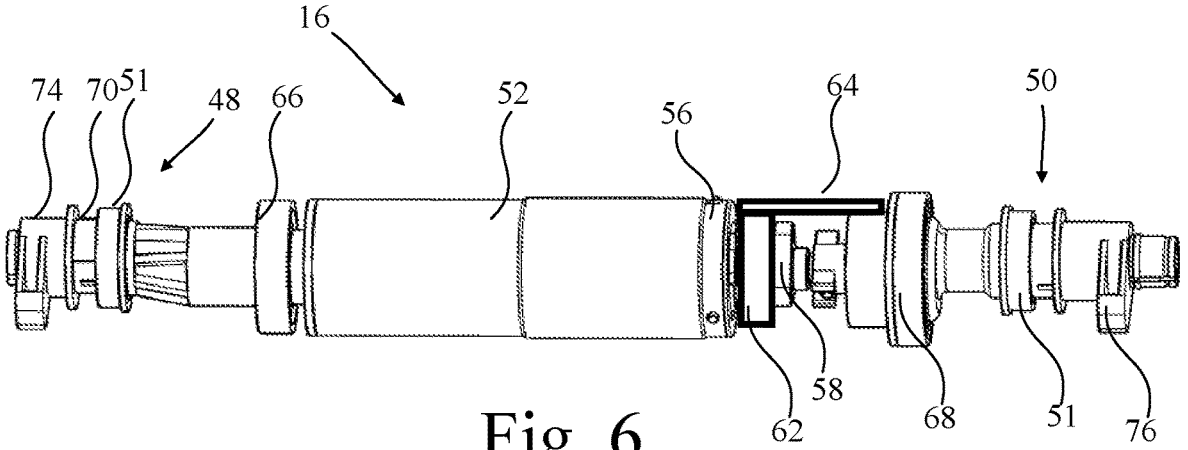
FIG. 6 is a front view of a drive mechanism of the cleaner head of FIG. 1 in isolation.
Figure 8:
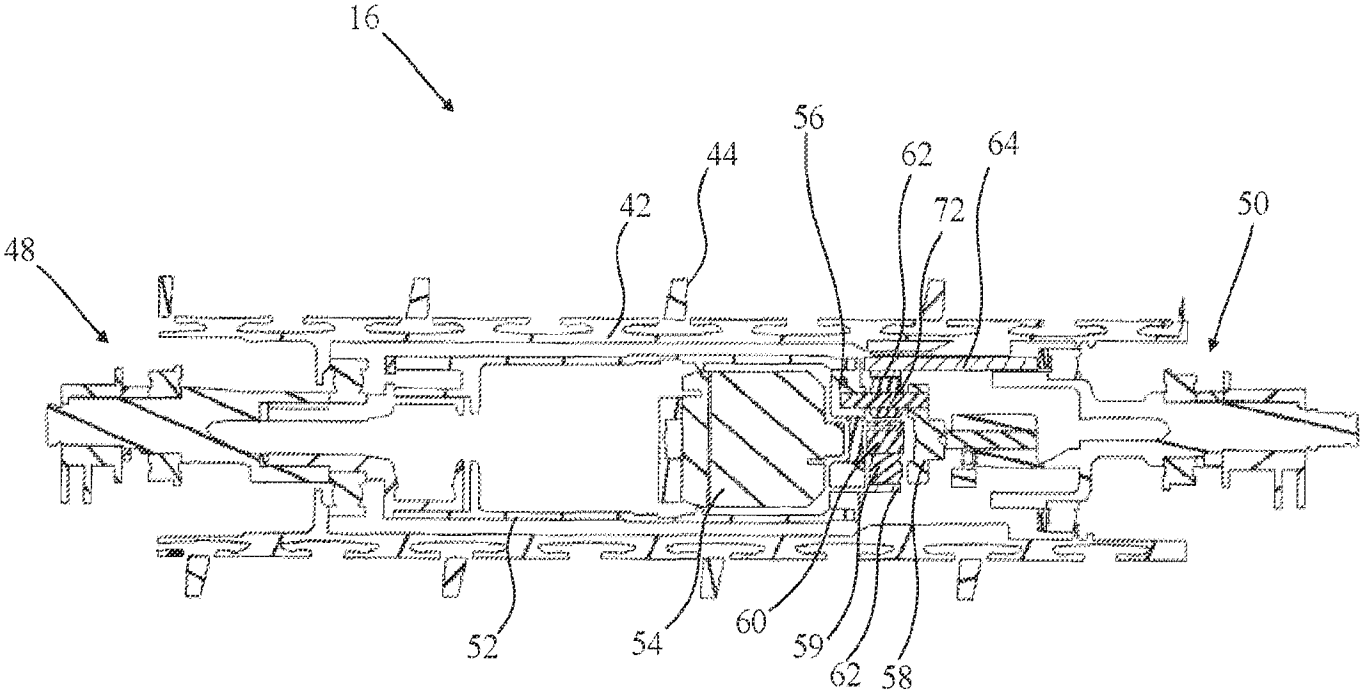
FIG. 8 is a sectional view of the drive mechanism of FIG. 6 taken along a central longitudinal axis of the drive mechanism.
Figure 9:
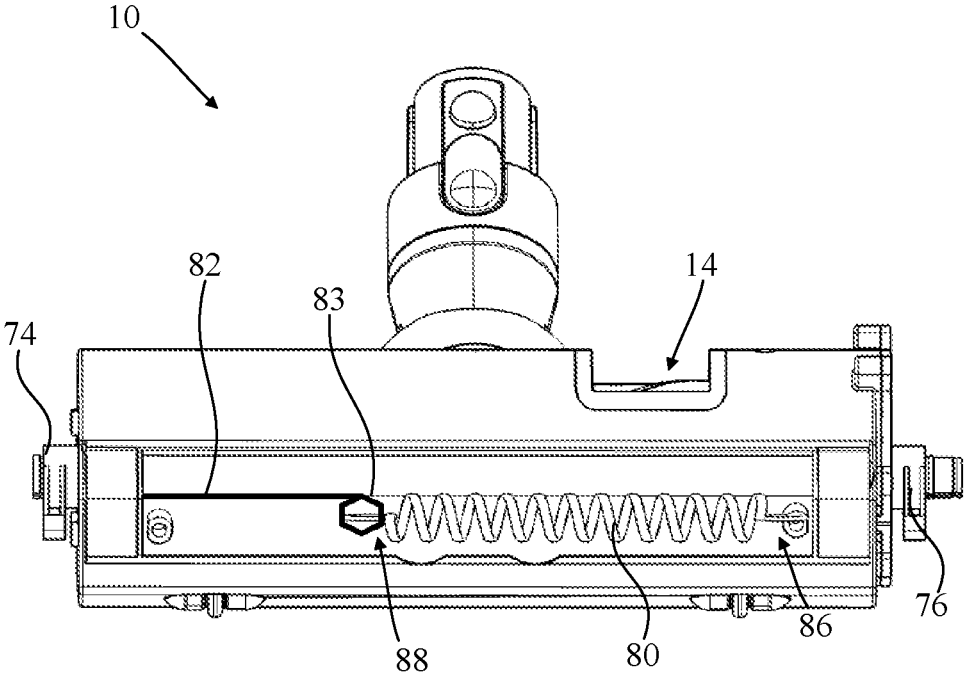
FIG. 9 is a front view of the cleaner head of FIG. 1 with its front wall removed.
Figure 10:
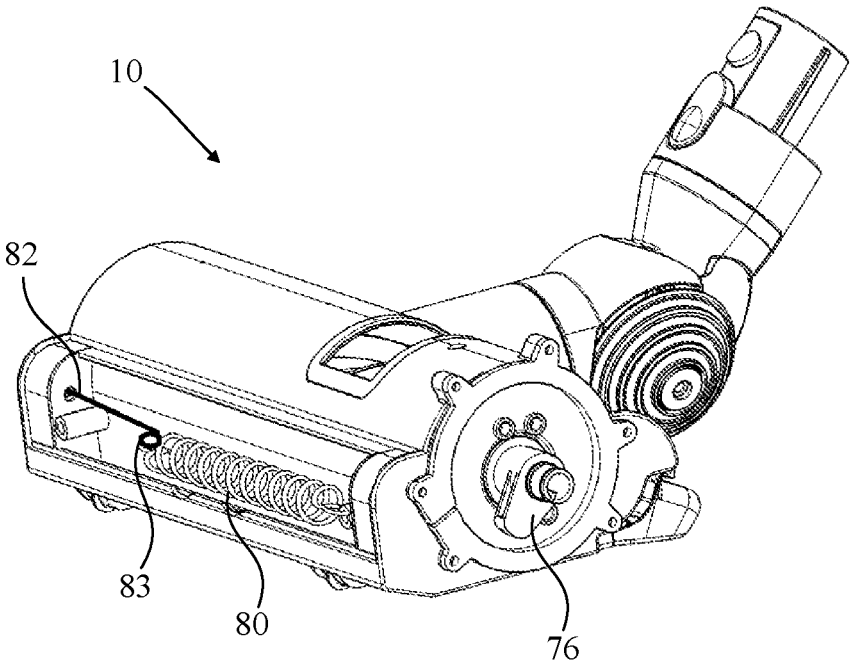
FIG. 10 is a second upper front perspective view of the cleaner head of FIG. 1 with its front wall removed.

The drive mechanism 16 is shown in isolation in FIGS. 6 and 8. The drive mechanism 16 has first 48 and second 50 end spigots, a drive housing 52, a motor 54, first 56 and second 58 planet carriers, planet gears 59 a sun gear 60, a ring gear 62, a drive dog 64, and first 66 and second 68 drive bearings.

The first 48 and second 50 end spigots are generally tubular in form, and are offset from a common central longitudinal axis A of the drive mechanism 16 and the brushbar 14. An outer surface of the first end spigot 48 has a drum-like collection member 70, about which a cable 82 of the biasing mechanism 18 can wind and unwind in use. The first 48 and second 50 end spigots are mounted to fixed points of the first side wall 28 and the end cap 40 by bearings 51, such that the first 48 and second 50 end spigots can rotate relative to the housing 12, within the agitator chamber 34 in use. The offset nature of the first 48 and second 50 end spigots means that the drive mechanism 16, and hence the brushbar 14, can move in upward/downward and forward/backward directions within the agitator chamber 34 in use.

Figure 7:
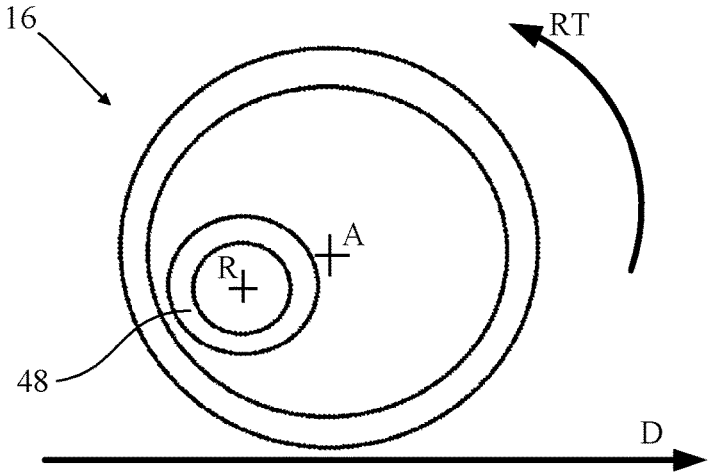
FIG. 7 is a schematic end view of the drive mechanism of FIG. 6.

The first 48 and second 50 end spigots define a rotational axis R of the drive mechanism 16. Due to the offset nature of the first 48 and second 50 end spigots from the common central longitudinal axis A of the drive mechanism 16 and the brushbar 14, the drive mechanism 16 and the brushbar 14 rotate about the rotational axis R of the drive mechanism 16 in an eccentric manner in use. The first 48 and second 50 offset spigots are positioned such that the defined rotational axis R is located rearward of the common central longitudinal axis A of the drive mechanism 16 and the brushbar 14, thereby ensuring that any reaction torque experienced drives the brushbar 14 upward within the agitator chamber 34 rather than downward. A schematic view of the end spigots 48,50 and the rotational axes A,R is shown in FIG. 7, with the arrow D representing the direction of movement of the cleaner head 10 in a forward direction away from a user in use, and the arrow RT representing a reaction torque experienced by the drive mechanism 16.

The drive housing 52 is generally tubular in form, extends from the first end spigot 48, and houses the motor 54 and at least a portion of the first planet carrier 56. The motor 54 is conventional in form, and provides a rotating output force to the sun gear 60 in use. Planet pins 72 rigidly connect the first 56 and second 58 planet carriers, and the second planet carrier 58 is rigidly connected to the second end spigot 50. The sun gear 60 is located between the first 56 and second 58 planet carriers, and is attached to the ring gear 62 via planet gears 59, whilst the ring gear 62 is in turn rigidly connected to the drive dog 64.

The drive mechanism 16 is configured such that the first 56 and second 58 planet carriers are stationary, whilst the ring gear 62 spins about the planet gears 59 as the planet gears 59 spin about their own axes, ie the planet gears 59 do not rotate about the sun gear 60. This enables a rigid connection between the first 48 and second 50 end spigots, which may retain the drive mechanism 16 and/or brushbar 14 substantially parallel to a surface to be cleaned when the drive mechanism 16 rotates about the rotational axis R in use.

In use, the sun gear 60 transmits the motor torque to the ring gear 62 via the planet gears 59, such that the drive dog 64 can cause rotation of the brushbar 14 about the common central longitudinal axis A of the drive mechanism 16 and the brushbar 14. The first 66 and second 68 drive bearings facilitate rotation of the brushbar 14 in use.

The drive mechanism 16 is located within the hollow interior 46 of the main body 42 of the brushbar 14, such that the drive mechanism 16 is protected from debris flowing into the agitator chamber 34 through the dirty air inlet 36 in use. In a presently preferred embodiment, the brushbar 14 covers the extent of the drive mechanism 16 located between the bearings 51. The drive mechanism 16 acts to position the brushbar 14 within the agitator chamber 34, and rotation of the drive mechanism 16 about the rotational axis R can move the brushbar within the agitator chamber 34.

Figure 11:
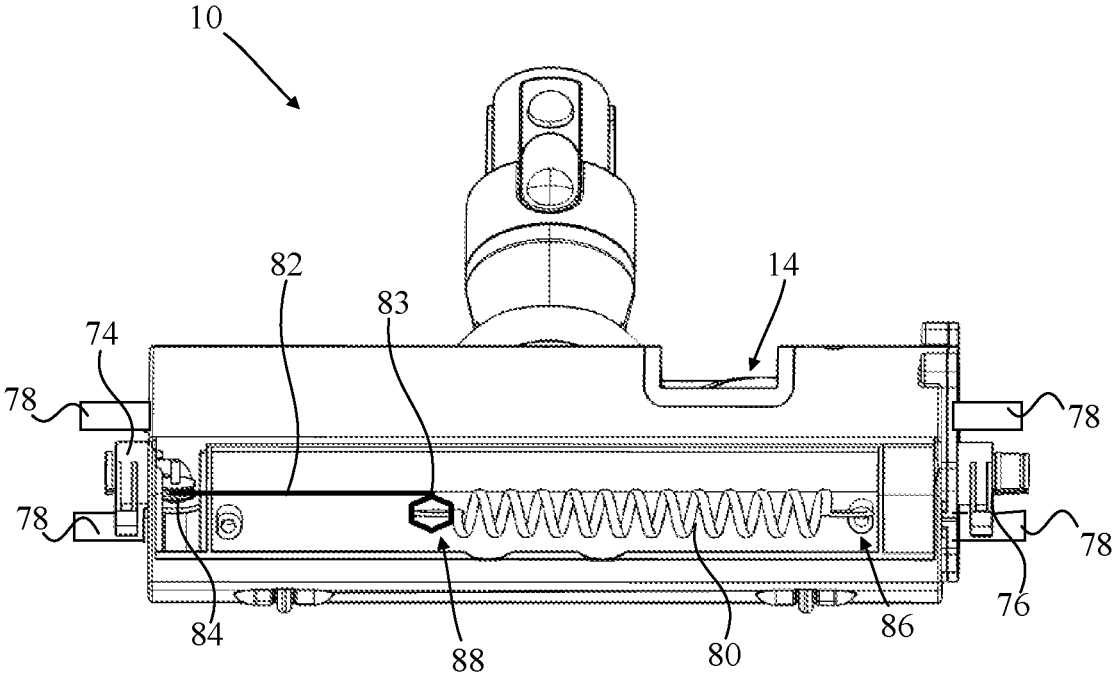
FIG. 11 is a first schematic front view of the cleaner head of FIG. 1 with stop pins in place.
Figure 12:
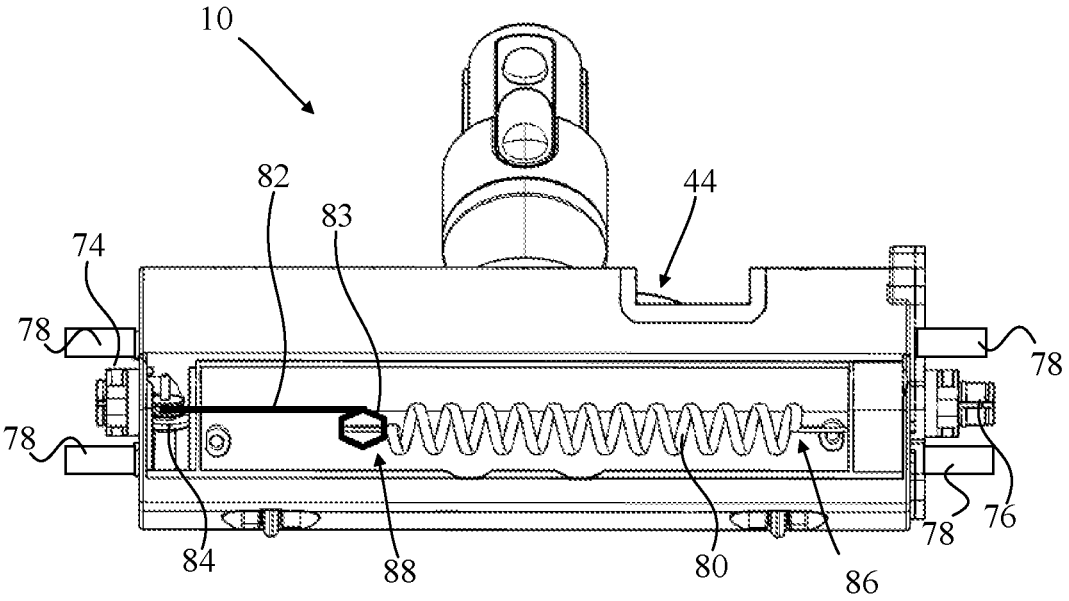
FIG. 12 is a second schematic front view of the cleaner head of FIG. 1 with stop pins in place.
Figure 13:
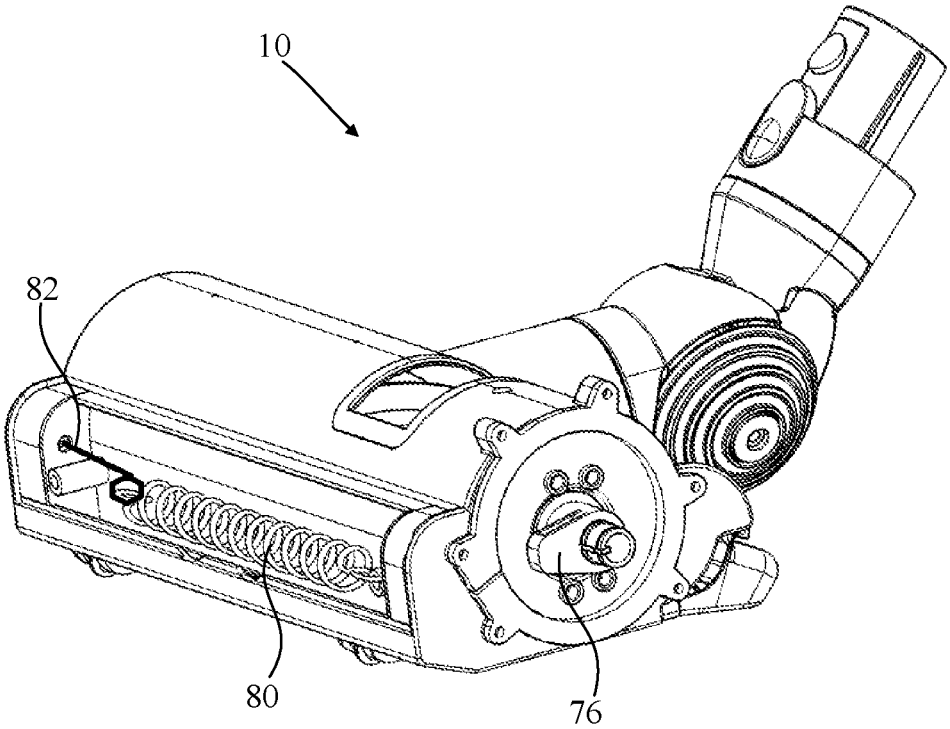
FIG. 13 is a third upper front perspective view of the cleaner head of FIG. 1 with the drive mechanism at a mid-point within the housing.
Figure 22:
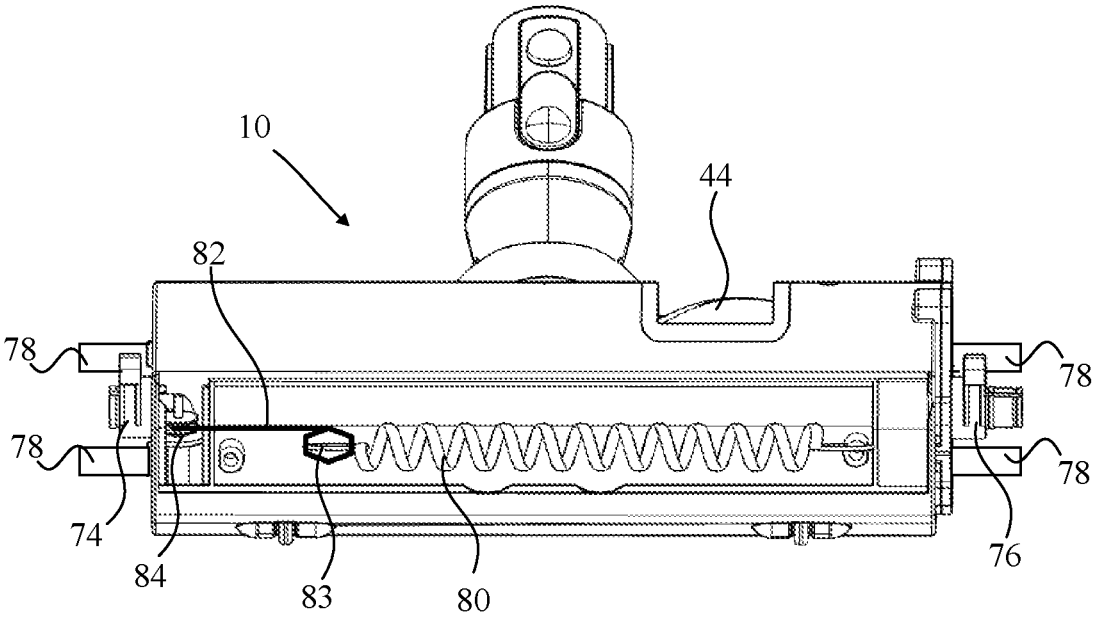
FIG. 22 is a third schematic front view of the cleaner head of FIG. 1 with stop pins in place.
Figure 23:
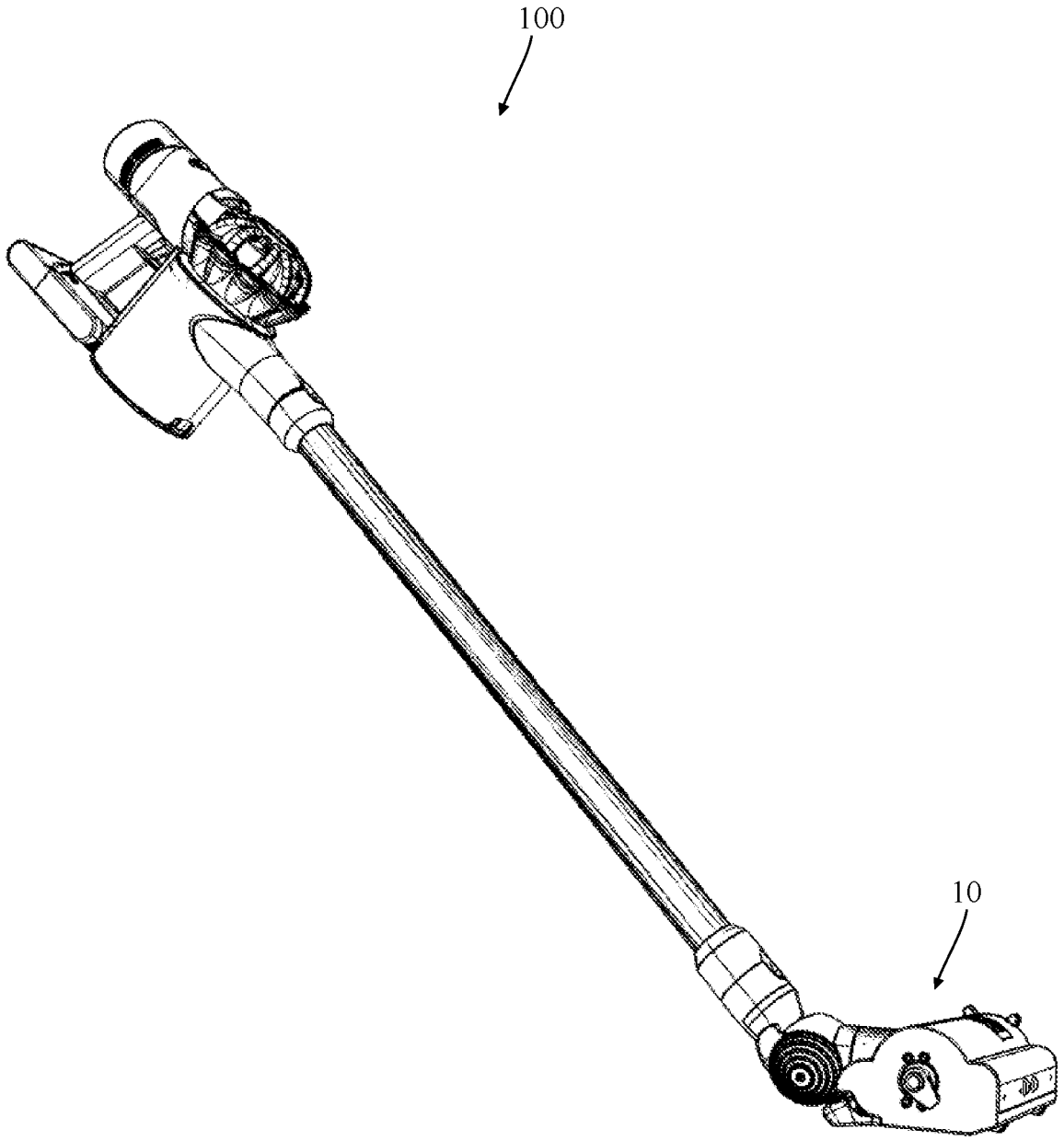
FIG. 23 is a schematic view of a vacuum cleaner according to various aspects of the present invention.

The drive mechanism 16 is connected to first 74 and second 76 stop members for engaging stop pins 78 formed on the cleaner head 10. In a presently preferred embodiment, the first 74 and second 76 stop members extend from ends of the respective first 48 and second 50 end spigots respectively. The stop pins 78 are shown in FIGS. 11, 12, and 22, and although the stop pins 78 are shown schematically as formed on an external surface of the cleaner head 10, and the first 74 and second 76 stop members are shown as extending outwardly from the cleaner head 10, it is also envisaged that the stop members 74,76 and the stop pins 78 can be located internally of the cleaner head 10. The first 74 and second 76 stop members and the stop pins 78 act to limit rotation of the drive mechanism 16 about the rotational axis R, and hence act to limit movement of the brushbar 14 within the agitator chamber 34 in use.

In the presently preferred embodiment, the stop members 74,76 and stop pins 78 are configured to restrict rotation to a range of 100°, from 40° to 140° measured relative to an axis perpendicular to a surface to be cleaned in use. This provides a smooth change in height of the brushbar 14 within the agitator chamber 34 with rotation of the drive mechanism 16. In a presently preferred embodiment, the offset between the rotational axis R, and the common central longitudinal axis A of the drive mechanism and the brushbar 14, is 3 mm. This would usually allow for a 6 mm range of motion between upper and lower positions of the brushbar 14 within the agitator chamber 34. However, restriction of motion to the range of angles identified above may limit the range of motion between upper and lower positions of the brushbar 14 within the agitator chamber 34 to a distance of 4.6 mm.

Figure 14:
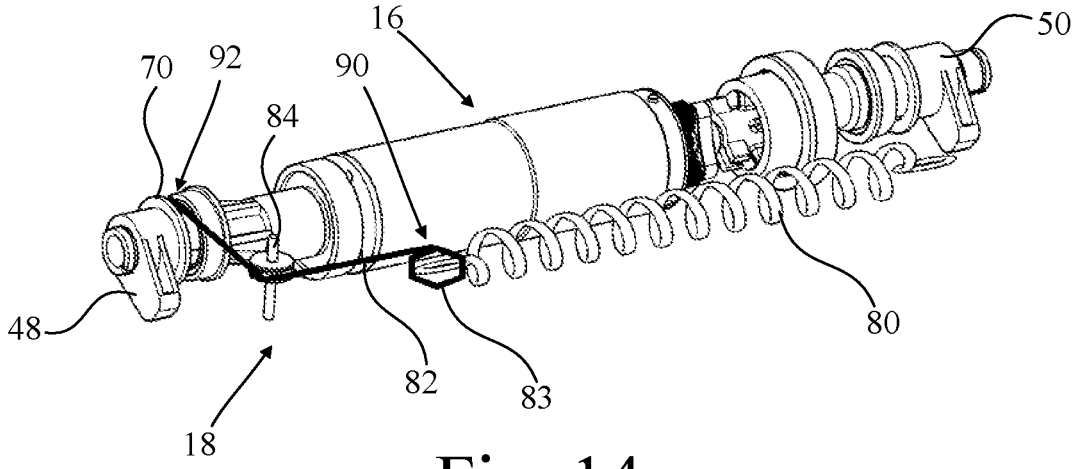
FIG. 14 is a schematic view illustrating the drive mechanism and biasing mechanism of the cleaner head of FIG. 1.

The biasing mechanism 18 comprises a coil spring 80, a cable 82, a pulley 84, and the drum-like collection member 70 of the first end spigot 48. A schematic view of the biasing mechanism 18 can be seen in FIGS. 14 and 15, where the line RT represents reaction torque experienced by the drive mechanism in use, and RF represents the restorative force of the coil spring 80 converted into a torque about the rotational axis R.

The coil spring 80 is a conventional coil spring, and is fixedly mounted at a first end 86 within the front chamber 38. The second end 88 of the coil spring 80 is connected to the cable 82. The coil spring 80 can be chosen to have a desired spring constant depending on the force the coil spring 80 is intended to produce.

The cable 82 is an inextensible cable, and can, for example, be fishing line or the like. It is presently preferred that the cable 82 is coated to reduce friction which may occur when the cable 82 moves within the cleaner head 10 in use. A first end 90 of the cable 82 is connected to the second end 88 of the coil spring 80 by a connection member 83, whilst a second end 92 of the cable 82 is connected to the drum-like collection member 70 of the first end spigot 48, such that at least a portion of the cable 82 is wound around the drum-like collection member 70 at all times. The cable 82 passes about the pulley 84 as it runs between the coil spring 80 and the drum-like collection member 70, and extends through channels (not-shown) in the housing 12 located in the path between the coil spring 80 and the drum-like collection member 70.

The cable 82 is wound around the drum-like collection member 70 such that the coil spring 80 is held in a high pre-loaded condition in the absence of any other applied forces. The cable 82 converts a restorative force of the coil spring 80 to a biasing torque on the drum-like collection member 70, and hence also to a torque on the drive mechanism 16 about the rotational axis R. The cable 82 is wound about the drum-like collection member 70 such that the biasing torque applied by the coil spring 80 about the rotational axis R is a force in a direction which opposes a reaction torque experienced when the brush bar 14 contacts a surface to be cleaned in use, ie the coil spring 80 generates a rotational force about the rotational axis R which is in a direction generally corresponding to the direction of rotation of the brushbar 14 about the common central longitudinal axis A of the drive mechanism 16 and the brushbar 14 within the agitator chamber 34 in use.

The highly pre-loaded nature of the coil spring 80 means that any extension of the coil spring 80 results only in a small increase in the restorative force of the coil spring. Thus any increase in restorative force caused by winding of the cable 82 onto the drum-like collection member, in turn caused by rotation of the drive mechanism 16 due to the experienced reaction torque, may be sufficiently small that the force provided by the coil spring can be thought of as substantially constant. Furthermore, the drum-like collection member 70 has a non-circular, elliptical cross-sectional shape, which also acts to minimise any variation in the restorative force of the coil spring 80 in use.

In the presently preferred embodiment, the initial position of the drive mechanism 16 and brushbar 14 is a position of minimum height within the agitator chamber 34, ie a position in which the distance between a surface to be cleaned and the brushbar 14 measured in a direction orthogonal to the surface to be cleaned is at a minimum. The drive mechanism 16, and hence the brushbar 14, are prevented from moving any closer to the surface to be cleaned by engagement of the first 74 and second 76 stop members with lowermost stop pins 78, as seen in FIG. 11. In the initial position, only the bristles of the brushbar 14 extend through the dirty air inlet 36 past the soleplate 26, and this may prevent the main body 42 of the brushbar 14 from contacting and damaging certain surfaces to be cleaned, for example a hard floor, in use.

Operation of the cleaner head will now be described, with reference to FIGS. 9-22.

Figure 17:
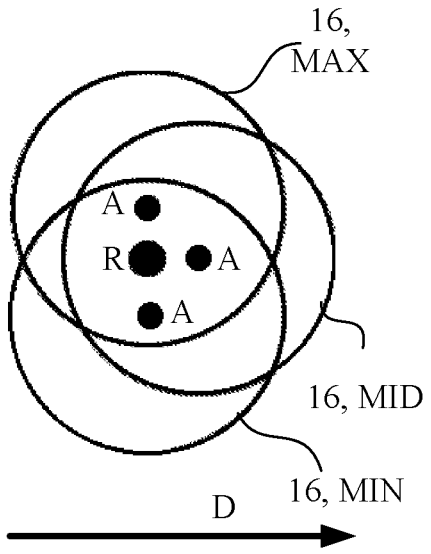
FIG. 17 is a schematic diagram illustrating the movement of the drive mechanism within the cleaner head of FIG. 1 in use.
Figure 18:
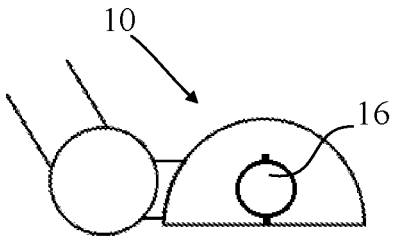
FIG. 18 is a schematic diagram illustrating a position of minimum height of the agitator of the cleaner head of FIG. 1.
Figure 19:
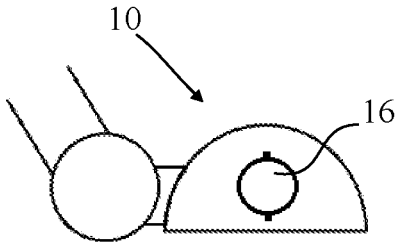
FIG. 19 is a schematic diagram illustrating a position of medium height of the agitator of the cleaner head of FIG. 1.

When it is desired to use the cleaner head 10, the cleaner head 10 is connected to a vacuum cleaner 100, and the cleaner head 10 is lowered onto a floor surface to be cleaned. Prior to the cleaner head 10 contacting the surface, the brushbar 14 is held at an initial minimum position within the agitator chamber 34, as seen in FIGS. 9-11 and 18. As the brushbar 14 rotates within the agitator chamber 34 about the central longitudinal axis A of the drive mechanism 16 and the brushbar 14, and contacts the surface, a reaction torque is experienced by the drive mechanism 16 in a direction opposite to the rotation of the brushbar 14.

Where the reaction torque is not balanced with the restorative force provided by the pre-loaded coil spring, ie when the reaction torque about the rotational axis R is greater than the biasing torque provided about the rotational axis R, the drive mechanism 16 will rotate about the rotational axis R in a direction generally opposite to the rotation of the brushbar 14. As previously discussed, the first 48 and second 50 offset spigots are positioned such that the rotational axis R is located rearward of the common central longitudinal axis A of the drive mechanism 16 and the brushbar 14, so that the drive mechanism 16 rotates about the rotational axis R in an eccentric manner, and the reaction torque experienced drives the brushbar 14 upward within the agitator chamber 34, as seen in FIG. 17. In FIG. 17, MIN represents an initial minimum position of the brushbar 14, MID represents a position of medium height of the brushbar 14 within the agitator chamber 34, and MAX represents a position of maximum height of the brushbar 14 within the agitator chamber 34.

Figure 15:
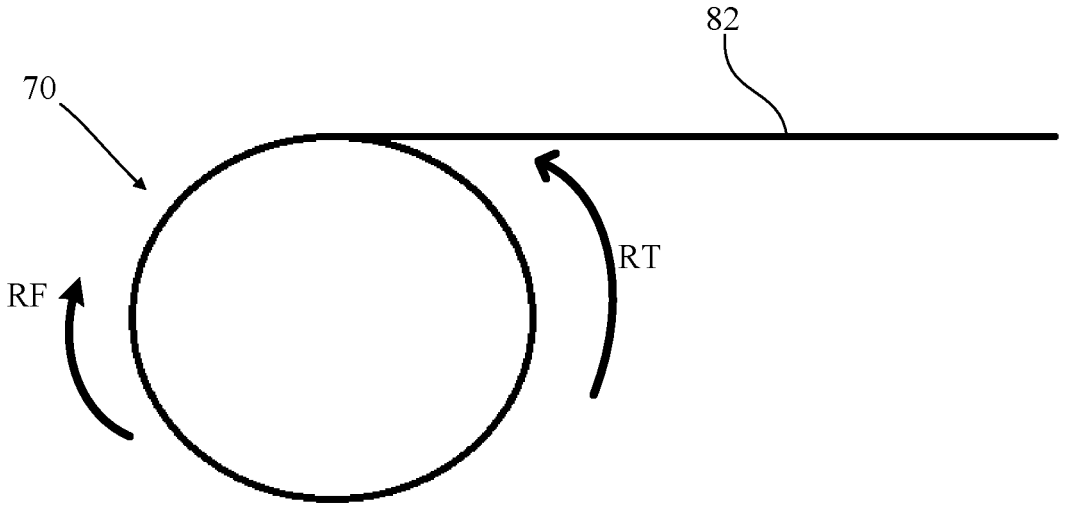
FIG. 15 is a schematic diagram illustrating the interaction between the drive mechanism and biasing mechanism of the cleaner head of FIG. 1.

As the drive mechanism 16 rotates about the rotational axis R in a direction generally opposite to the rotation of the brushbar 14, more of the length of the cable 82 is wound onto the drum-like collection member 70 of the first end spigot 48, as shown schematically in FIG. 15. However, the high pre-loading of the coil spring 80 means that the variation in length of the coil spring 80 only produces a small variation in force, such that the restorative force of the coil spring 80 can be thought of as substantially constant. As the cable 82 passes around the pulley 84 and onto the drum-like collection member 70, the cable 82 converts the restorative force of the coil spring 80 into a biasing torque about the rotational axis R which opposes the reaction torque. As the drive mechanism 16 moves upward within the agitator chamber 34, the experienced reaction torque decreases as the brushbar 14 moves out of contact with the surface, until the experienced reaction torque to is equal to the restorative force of the coil spring 80, ie until the experienced reaction torque is equal to the biasing torque.

Figure 16:
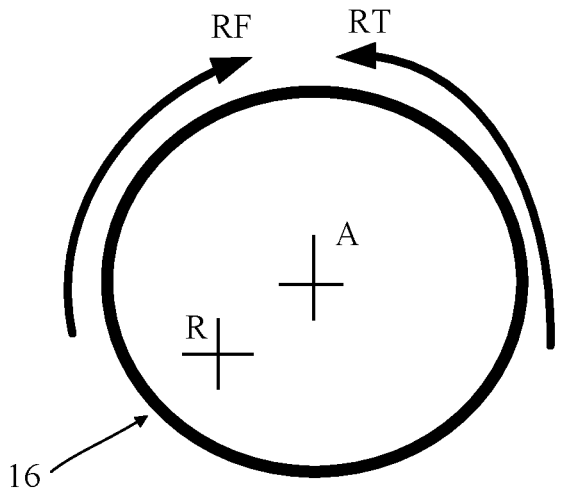
FIG. 16 is a schematic diagram illustrating torques which act on the drive mechanism of the cleaner head of FIG. 1 in use.

At this point, rotation of the drive mechanism 16 about the rotational axis R ceases, and the drive mechanism 16, and hence the brushbar 14, are held at a fixed height within the agitator chamber 34. A schematic force diagram is shown in FIG. 16. As the restorative force of the coil spring 80, converted into a biasing torque about the rotational axis R, is substantially constant, and the drive mechanism 16 is able to move within the agitator chamber 34 until the experienced reaction torque is equal to the restorative force of the coil spring 80, the experienced reaction torque is also substantially constant, irrespective of the surface upon which the cleaner head 10 is used. This may enable the cleaner head to have a substantially constant power draw across all surfaces. A configuration in which the restorative force of the coil spring 80 is equal to the experienced reaction torque can be seen in FIGS. 12-13 and 19.

The biasing mechanism 18 ensures a constant power draw both as the cleaner head 10 is moved backward and forward across the surface in use, and indeed where the cleaner head 10 is used on different surfaces.

As the variation of power draw on different surfaces to be cleaned no longer needs to be taken into account, the drive mechanism 16 may operate closer to its chosen optimum operating point than in cleaner heads known in the art. This may increase the pick-up performance of the cleaner head 10 relative to known cleaner heads. Furthermore, the cleaner head 10 may reduce or remove any variations in power draw that typically occur as a result of varying bristle height due to manufacturing tolerances.

Where the reaction torque experienced by the drive mechanism is insufficient to match the restorative force of the coil spring 80 in its pre-loaded position, the drive mechanism 16, and hence the agitator 14, is held at its initial position of minimum height within the agitator chamber 34.

Figure 20:
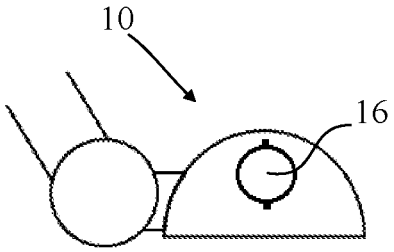
FIG. 20 is a schematic diagram illustrating a position of maximum height of the agitator of the cleaner head of FIG. 1.
Figure 21:
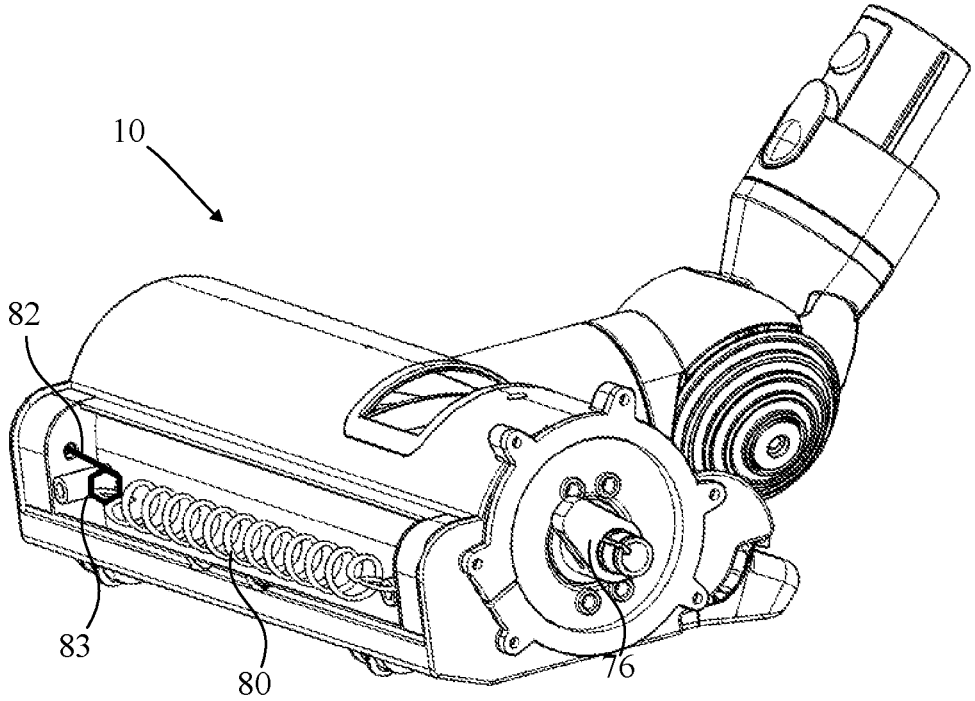
FIG. 21 is a third upper front perspective view of the cleaner head of FIG. 1 with the drive mechanism at a maximum within the housing.

A position of maximum height of the brushbar 14 within the agitator chamber 34 is shown in FIGS. 20-22, and in this position the coil spring 80 is at a maximum extended position within the front chamber 38.

The invention claimed is:

1. A cleaner head for a vacuum cleaner, the cleaner head comprising a housing, an agitator mounted within the housing, and a drive mechanism for driving the agitator about a first axis, wherein the drive mechanism is mounted to the housing for rotation about a second axis, the second axis is offset from the first axis, and when the agitator is brought into contact with a surface to be cleaned, the surface exerts a reaction torque on the agitator that causes the drive mechanism to rotate about the second axis.

2. The cleaner head of claim 1, wherein the agitator is hollow, and the drive mechanism is housed at least partially within the agitator.

3. The cleaner head of claim 1, wherein the drive mechanism and the agitator comprise a common central longitudinal axis such that the drive mechanism and the agitator are concentrically arranged within the housing, and the first axis comprises the common central longitudinal axis.

4. The cleaner head of claim 1, wherein the second axis is located behind the first axis.

5. The cleaner head of claim 1, wherein the cleaner head comprises a stop mechanism for restricting rotation of the drive mechanism about the second axis.

6. The cleaner head of claim 1, wherein rotation of the drive mechanism about the second axis is restricted such that the entirety of the agitator, or the entirety of the agitator save for bristles of the agitator, is contained within the housing when the drive mechanism is at a position of minimum height within the housing.

7. The cleaner head of claim 1, wherein at least a portion of the main body of the agitator extends out of the housing when the drive mechanism is at a position of minimum height with the housing.

8. The cleaner head of claim 1, wherein the drive mechanism comprises first and second ends, and each of the first and second ends is rotatably connected to the housing such that the drive mechanism is rotatable about the second axis.

9. The cleaner head of claim 8, wherein at least a portion of the drive mechanism rigidly connects the first and second ends.

10. The cleaner head of claim 1, wherein the cleaner head comprises a biasing mechanism which exerts a biasing torque on the drive mechanism that acts in a first direction about the second axis, and when the agitator is brought into contact with a surface to be cleaned, the reaction torque on the drive mechanism acts in a second opposite direction about the second axis.

11. The cleaner head of claim 10, wherein the biasing torque is at least one of opposite to and equal to a reaction torque experienced by the drive mechanism in use.

12. The cleaner head of claim 10, wherein the biasing torque retains the drive mechanism at an initial position of minimum height of the drive mechanism within the housing in the absence of an experienced reaction torque.

13. The cleaner head of claim 10, wherein the drive mechanism comprises at least one spigot defining the second axis, and the biasing mechanism is connected to the at least one spigot such that the biasing mechanism is able to transmit the biasing torque about the second axis.

14. The cleaner head of claim 10, wherein the biasing mechanism comprises a resiliently deformable member held under tension.

15. The cleaner head of claim 14, wherein the resiliently deformable member comprises at least one spring.

16. The cleaner head of claim 15, wherein the at least one spring comprises a single spring.

17. The cleaner head of claim 15, wherein the at least one spring comprises a coil spring.

18. The cleaner head of claim 10, wherein the housing comprises a chamber within which the agitator and drive mechanism are mounted, a dirty air inlet in fluid communication with the chamber, and a further chamber within which the biasing mechanism is located.

19. A vacuum cleaner comprising the cleaner head of claim 1.

* * * * *